United States Patent [19]

Frame

[11] Patent Number: 4,498,977

[45] Date of Patent: Feb. 12, 1985

[54] CATALYTIC OXIDATION OF MERCAPTAN IN PETROLEUM DISTILLATE

[75] Inventor: Robert R. Frame, Glenview, Ill.

[73] Assignee: UOP Inc., Des Plaines, Ill.

[21] Appl. No.: 555,910

[22] Filed: Nov. 29, 1983

[51] Int. Cl.[3] ..... C10G 27/10; C10G 29/00

[52] U.S. Cl. ..... 208/207; 208/189; 502/163

[58] Field of Search ..... 208/189, 207; 502/163

[56] References Cited

U.S. PATENT DOCUMENTS

| | | | |
|---|---|---|---|
| 2,988,500 | 6/1961 | Gleim et al. | 208/206 |
| 3,029,201 | 4/1962 | Brown et al. | 502/163 |
| 3,408,287 | 10/1968 | Urban et al. | 208/207 |
| 4,206,079 | 6/1980 | Frame | 502/163 |
| 4,293,442 | 10/1981 | Frame | 502/163 |
| 4,318,825 | 3/1982 | Frame | 502/163 |
| 4,364,843 | 12/1982 | Carlson | 502/163 |

*Primary Examiner*—Delbert E. Gantz
*Assistant Examiner*—Helane Myers
*Attorney, Agent, or Firm*—William H. Page, II; John G. Cutts, Jr.

[57] ABSTRACT

A process for sweetening a sour hydrocarbon fraction containing mercaptan which comprises reacting mercaptans contained in the hydrocarbon fraction with an oxidizing agent by passing the hydrocarbon fraction and the oxidizing agent into contact with a bed of metal chelate mercaptan oxidation catalyst and a solid carrier material having an average particle size of less than about 110 mesh.

7 Claims, 1 Drawing Figure

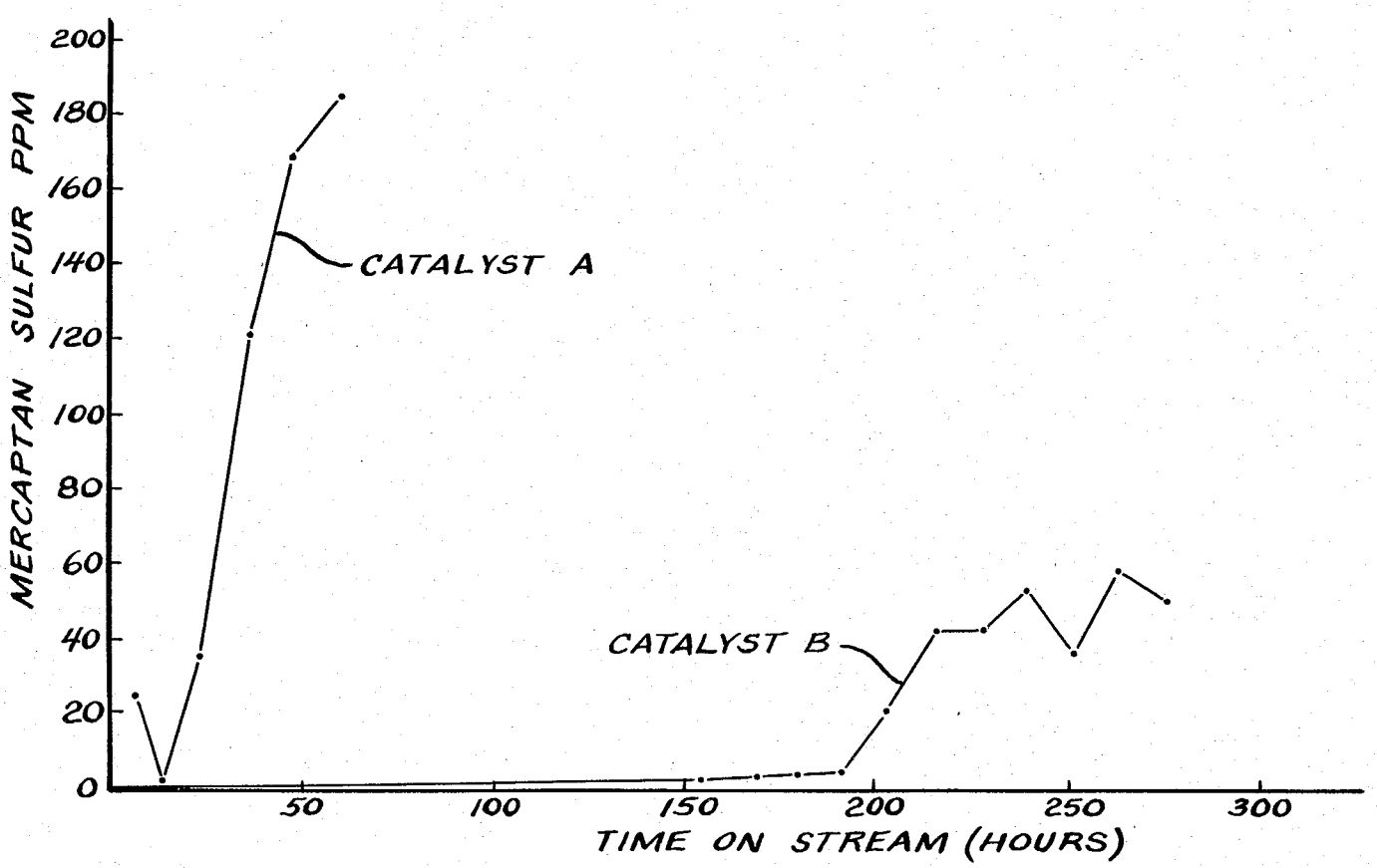
MERCAPTAN SULFUR PPM
200
180
160
140
120
100
80
60
40
20
0
50
100
150
200
250
300
TIME ON STREAM (HOURS)
CATALYST A
CATALYST B

CATALYTIC OXIDATION OF MERCAPTAN IN PETROLEUM DISTILLATE

BACKGROUND OF THE INVENTION

FIELD OF THE INVENTION

The field of art to which the present invention pertains is the treatment of sour petroleum distillates or fractions, the treatment being commonly referred to as sweetening. More specifically, the present invention relates to treating sour petroleum distillates with a metal chelate mercaptan oxidation catalyst having an average particle size of less than about 110 mesh.

INFORMATION DISCLOSURE

Processes for the treatment of a sour petroleum distillate wherein said distillate is treated, in the presence of an oxidizing agent at alkaline reaction conditions, with a supported metal phthalocyanine catalyst dispersed on a fixed bed in a treating or reaction zone, have become well known and widely accepted in the industry. The treating process is typically designed to effect the catalytic oxidation of offensive mercaptans contained in the sour petroleum distillate with the formation of innocuous disulfides. Gasoline, including natural, straight run and cracked gasolines, is the most frequently treated sour petroleum distillate. Other sour petroleum distillates include the normally gaseous petroleum fraction as well as naphtha, kerosene, jet fuel, fuel oil and the like.

A commonly used continuous process for treating sour petroleum distillates entails treating the distillate in contact with a metal phthalocyanine catalyst dispersed in an aqueous caustic solution to yield a doctor sweet product. The sour distillate and the catalyst-containing aqueous caustic solution provide a liquid-liquid system wherein mercaptans are converted to disulfides at the interface of the immiscible solutions in the presence of an oxidizing agent—usually air. Sour petroleum distillates containing more difficultly oxidizable mercaptans are more effectively treated in contact with a metal phthalocyanine catalyst disposed on a high surface area adsorptive support—usually a metal phthalocyanine on an activated charcoal. The distillate is treated in contact with the supported metal phthalocyanine catalyst at oxidation conditions in the presence of an alkaline agent. One such process is described in U.S. Pat. No. 2,988,500. The oxidizing agent is most often air admixed with the distillate to be treated, and the alkaline agent is most often an aqueous caustic solution charged continuously to the process or intermittently as required to maintain the catalyst in a caustic-wetted state.

In U.S. Pat. No. 2,988,500 (Gleim et al.), the solid catalyst particles were exemplified having a carrier size in the range of 30 to 40 mesh. In U.S. Pat. No. 3,408,287 (Urban et al.), the solid catalyst particles for sweetening sour hydrocarbons were exemplified having a carrier size in the range of 60 to 100 mesh. Generally, the prior art has taught that hydrocarbon sweetening catalyst is supported on relatively finely divided particles.

The prior art discloses that there are limitations on the ability to treat a sour petroleum distillate with a catalytic composite consisting of a metal phthalocyanine disposed on a carrier material. Various improvements have been developed to further enhance the sweetening ability including the use of certain additives in the distillate treating process.

The prior art does not disclose or suggest, however, that a sour mercaptan-containing hydrocarbon distillate may be more effectively treated by a method comprising contacting the distillate at oxidation conditions with a mercaptan oxidation catalyst and a solid carrier material having an average particle size of less than about 110 mesh. I have discovered surprising and unexpected results when utilizing a supported oxidation catalyst of the present invention having a particle size or less than about 110 mesh to sweeten hydrocarbon distillates.

SUMMARY OF THE INVENTION

One embodiment of the present invention is a process for sweetening a sour hydrocarbon fraction containing mercaptan which comprises reacting mercaptans contained in the hydrocarbon fraction with an oxidizing agent by passing the hydrocarbon fraction and the oxidizing agent into contact with a bed of metal chelate mercaptan oxidation catalyst and a solid carrier material having an average particle size of less than about 110 mesh.

Another embodiment of the present invention is a catalytic composite comprising a metal chelate mercaptan oxidation catalyst and a solid carrier material having an average particle size of less than about 110 mesh.

Other embodiments of the present invention encompass further details such as feedstocks, catalyst carrier materials, preferred catalyst compositions and process operating conditions, all of which are hereinafter disclosed in the following discussion of each of these facets of the invention.

BRIEF DESCRIPTION OF THE DRAWING

The drawing is a graphical comparison of the performance of the catalyst of the present invention, Catalyst B, with a prior art catalyst, Catalyst A.

DETAILED DESCRIPTION OF THE INVENTION

I have discovered as extraordinarily active and stable catalyst which is useful for the oxidation of mercaptans which are contained in distillate hydrocarbons. The outstanding characteristics of my catalyst have permitted the sweetening of hydrocarbons without the addition of alkaline reagents while maintaining extended mercaptan conversion activity.

The prior art has always relied upon the presence of alkaline reagents to retard the rapid deactivation of metal chelate catalysts during hydrocarbon sweetening. The presence of alkaline reagents are always considered to be a necessary element for the sweetening reaction and one which was to be tolerated. The usage of alkaline reagents was undesirable in that the provision of the alkaline reagent was an added expense, the post-treatment separation of the alkaline reagent from the product had to be ensured, the compatibility of the processing unit had to be maintained with regard to the chemically agressive characteristics of many of the alkaline reagents and the spent alkaline reagents had to be disposed of in an environmentally acceptable manner.

As mentioned above, the prior art has long recognized the ability of particles of metal chelate catalyst and in particular phthalocyanine catalyst to oxidize mercaptans, but those skilled in the art have failed to discover the surprising and totally unexpected results of my invention.

The metal chelate mercaptan oxidation catalyst employed as a component of the catalytic composite of this invention can be any of the various metal chelates known to the treating art as effective to catalyze the oxidation of mercaptans contained in a sour petroleum distillate with the formation of polysulfide oxidation products. Said chelates include the metal compounds of tetrapyridinoporphyrazine described in U.S. Pat. No. 3,980,582, e.g., cobalt, tetrapyridinoporphyrazine; porphyrin and metaloporphyrin catalysts as described in U.S. Pat. No. 2,966,453, e.g., cobalt tetraphenylporphrin sulfonate; corriniod catalysts as described in U.S. Pat. No. 3,252,892, e.g., cobalt corrin sulfonate; chelate organo-metallic catalysts such as described in U.S. Pat. No. 2,918,426, e.g., the condensation product of an aminophenol and a metal of Group VIII; and the like. Metal phthalocyanines are a preferred class of metal chelate mercaptan oxidation catalysts.

The carrier material herein contemplated includes the various and well known adsorbent materials in general use as catalyst supports. Preferred carrier materials include the various charcoals produced by the destructive distillation of wood, peat, lignite, nut shells, bones, and other carbonaceous matter, and preferably such charcoals as have been heat treated, or chemically treated, or both, to form a highly porous particle structure of increased adsorbent capacity, and generally defined as activated charcoal. Said carrier materials also include the naturally occurring clays and silicates, for example, diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof, like silica-alumina, silica-zirconia, alumina-zirconia, etc. Any particular carrier material is selected with regard to its stability under conditions of its intended use. For example, in the treatment of a sour petroleum distillate, the carrier material should be insoluble in, and otherwise inert to, the petroleum distillate at conditions typically existing in the treating zone. Charcoal, and particularly activated charcoal, is preferred because of its capacity for metal phthalocyanine and because of its stability under treating conditions. However, it should be observed that the method of this invention is also applicable to the preparation of a metal chelate composited with any of the other well known carrier materials, particularly the refractory inorganic oxides.

The metal phthalocyanines which may be employed to catalyze the oxidation of mercaptans contained in sour petroleum distillates generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, nickel phthalocyanine, platinum phthalocyanine, silver phthalocyanine, zinc phthalocyanine, tin phthalocyanine, and the like. Cobalt phthalocyanine, iron phthalocyanine, manganese phthalocyanine and vanadium phthalocyanine are particularly preferred. The metal phthalocyanine is more frequently employed as a derivative therof, the commercially available sulfonated derivatives, e.g., cobalt phthalocyanine monosulfonate, cobalt phthalocyanine disulfonate or a mixture thereof being particularly preferred. The sulfonated derivatives may be prepared, for example, by reacting cobalt, vanadium, or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

In accordance with the present invention and regardless of which carrier material is selected, the particles of carrier material must be less than about 110 mesh. A preferred range of carrier particle size is from about 115 to about 200 mesh. The composite of metal chelate and carrier may be prepared in any suitable manner. In one method the carrier may be formed into particles of uniform or irregular size and shape and the carrier is intimately contacted with a solution of the metal chelate catalyst and in particular the phthalocyanine catalyst. An aqueous or alkaline solution of the metal chelate catalyst is prepared and, in a preferred embodiment, the carrier particles are soaked, dipped, suspended or immersed in the solution. In another method, the solution may be sprayed onto, poured over or otherwise contacted with the carrier. Excess solution may be removed in any suitable manner and the carrier containing the catalyst allowed to dry at ambient temperature, dried in an oven or by means of hot gases passed thereover, or in any other suitable manner. In general, it is preferred to composite as much metal chelate with the carrier as will form a stable composite, although a lesser amount may be so deposited, if desired. In one preparation, a cobalt phthalocyanine sulfonate was composited with activated carbon by soaking granules of carbon having a particle size in the range from about 120 to about 200 mesh in the phthalocyanine solution. In another method, the carrier may be deposited in the treating zone and the phthalocyanine solution passed therethrough in order to form the catalyst composite in situ. If desired, the solution may be recycled one or more times in order to prepare the desired composite. In still another embodiment, the carrier may be loaded in the treating chamber and the chamber filled with a solution of phthalocyanine, thereby forming the composite in situ.

A preferred method of contacting the catalyst with the hydrocarbon feedstock is to install the catalyst in a fixed bed inside the treating zone. The method of supporting beds of solid material in treating zones is well known and need not be described in detail herein.

Treating of the sour hydrocarbon distillate in a treating zone generally is effected at ambient temperature, although elevated temperature may be used but will not generally exceed about 300° F. Atmospheric pressure is usually employed, although superatmospheric pressure up to about 1000 psig may be employed if desired. The time of contact in the treating zone may be selected to give the desired reduction in mercaptan content and may range from about 0.1 to about 48 hours or more, depending upon the size of the treating zone, the amount of catalyst and the particular hydrocarbon distillate being treated. More specifically, contact times equivalent to a liquid hourly space velocity from about 0.5 to about 15 or more are effective to achieve a desired reduction in the mercaptan content of a sour hydrocarbon distillate.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing gas may be employed. In fixed bed treating operations, the sour petroleum distillate may be passed upwardly or downwardly through the catalytic composite. The sour petroleum distillate may contain sufficient entrained air, but generally added air is admixed with the distillate and charged to the treating zone concurrently therewith. In some cases, it may be of advantage to charge the air separately to the treating zone and countercurrent to the distillate separately charged thereto.

An optional component of the catalyst of the present invention is a quaternary ammonium salt which is represented by the structural formula:

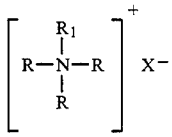

wherein R is a hydrocarbon radical containing up to about 20 carbon atoms and selected from the group consisting of alkyl, cycloalkyl, aryl, alkaryl and aralkyl, $R_1$ is a substantially straight chain alkyl radical containing from about 5 to about 20 carbon atoms, and X is an anion selected from the group consisting of halide, nitrate, nitrite, sulfate, phosphate, acetate, citrate and tartrate. $R_1$ is preferably of alkyl radical containing from about 12 to about 18 carbon atoms, at least one R is preferably benzyl, and X is preferably chloride. Preferred quaternary ammonium salts thus include benzyldimethyldodecylammonium chloride, benzyldimethyltetradecylammonium chloride, benzyldimethylhexadecylammonium chloride, benzyldimethyloctadecylammonium chloride, and the like. Other suitable quaternary ammonium salts are disclosed in U.S. Pat. No. 4,157,312 which is incorporated herein by reference.

The catalyst of the present invention preferably contains a metal chelate in the amount from about 0.01 to about 20 weight percent. In the event that the catalyst of the present invention contains a quaternary ammonium salt, it is preferred that said salt is present in an amount from about 1 to about 50 weight percent of the finished catalyst.

The following example is given to illustrate further my process for sweetening a sour hydrocarbon fraction containing mercaptan. The example is not to be construed as an undue limitation on the generally broad scope of the invention as set out in the appended claims and is therefore intended to be illustrative rather than restrictive.

EXAMPLE

A prior art catalytic composite comprising cobalt phthalocyanine sulfonate and a quaternary ammonium salt on activated charcoal was prepared in the following manner. An impregnating solution was formulated by adding 0.15 grams of cobalt phthalocyanine monosulfonate and 4 grams of a 50% alcoholic solution of dimethylbenzylalkylammonium chloride to 150 ml of deionized water. About 100 cc of 10×30 mesh activated charcoal particles were immersed in the impregnating solution and allowed to stand until the blue color disappeared from the solution. The resulting impregnated charcoal was filtered, water washed and dried in an oven for about one hour at 212° F. The catalytic composite thus prepared, hereinafter referred to as Catalyst A, was subjected to a comparative evaluation test relative to the catalyst of the present invention. Two other prior art catalysts were prepared in the same manner described above with the exception that 0.3 and 0.6 grams, respectively, of cobalt phthalocyanine monosulfonate was impregnated on 100 cc of 10×30 mesh charcoal which represented an effort to maximize the cobalt content of the finished catalyst in an attempt to achieve better catalyst activity. These latter two catalysts which contained 100% and 400% more phthalocyanine than Catalyst A demonstrated a hydrocarbon sweetening activity which was inferior to that of Catalyst A. Any further attempts by a person skilled in the art to improve catalyst performance by the mere incorporation of additional phthalocyanine would therefore seem to be fruitless. Therefore, it is believed that Catalyst A represents the best hydrocarbon sweetening catalyst known in the prior art. The catalyst of the present invention, herein referred to as Catalyst B, was prepared by impregnating about 61 cc of 120×200 mesh activated charcoal particles with an impregnating solution which contained 3.7 grams of cobalt phthalocyanine monosulfonate and 2.61 grams of a 50% alcoholic solution of dimethylbenzylalkylammonium chloride and 200 cc of water. The charcoal and the impregnating solution were allowed to stand until the blue color disappeared from the solution. The resulting impregnated charocal was filtered, water washed and dried in an oven.

Catalyst A and Catalyst B contained 0.15 and 6 grams of cobalt phthalocyanine per 100 cc of charcoal, respectively.

The comparative evaluation test consisted in processing a sour FCC gasoline containing about 550 ppm mercaptan downflow through 100 cc of catalyst disposed as a fixed bed in a vertical tubular reactor. The FCC gasoline was charged at an LHSV of about 8 together with an amount of air sufficient to provide about two times the stoichiometric amount of oxygen required to oxidize the mercaptans contained in the FCC gasoline. No caustic or any other alkaline reagent was charged to the reactor before or during the test. The treated FCC gasoline was analyzed periodically for mercaptan sulfur. The mercaptan sulfur content of the treated FCC gasoline was plotted against the hours on stream to provide the two curves presented in the drawing. The maximum commercially acceptable mercaptan level in FCC gasoline is about 10 ppm.

From the drawing, it is apparent that when Catalyst A which is representative of a commercially successful catalyst and which relies on the presence of an alkaline reagent (generally an aqueous sodium hydroxide solution) to achieve satisfactory hydrocarbon sweetening is subjected to the hereinabove described test without the presence of an alkaline reagent, the time period during which commercially acceptable product is produced is practically nil. However, on the other hand, the catalyst of the present invention, Catalyst B, was able to produce a commercially acceptable product for about 200 hours. Therefore, the discovery of a hydrocarbon sweetening catalyst which will give outstanding performance in the absence of an alkaline reagent is an extraordinary advance in the art of sweetening.

The foregoing description, drawing and example clearly demonstrate that a vastly superior metal chelate catalyst is available when the average catalyst particle size is less than about 110 mesh.

I claim as my invention:

1. A process for sweetening a sour hydrocarbon fraction containing mercaptan which comprises reacting mercaptans contained in said hydrocarbon fraction with an oxidizing agent in the absence of an alkaline reagent by passing said hydrocarbon fraction and said oxidizing agent without alkaline reagent into contact with a bed of a catalytic composite comprising a metal chelate mercaptan oxidation catalyst and a solid carrier material having an average particle size of less than about 110 mesh.

2. The process of claim 1 wherein said sour hydrocarbon fraction is gasoline.

3. The process of claim 1 wherein said sour hydrocarbon fraction is kerosene.

4. The process of claim 1 wherein said oxidizing agent is air.

5. The process of claim 1 wherein said carrier material comprises carbon.

6. The process of claim 1 wherein said carrier material comprises an inorganic oxide carrier.

7. The process of claim 1 wherein said metal chelate comprises cobalt phthalocyanine sulfonate.

* * * * *